US006945356B2

(12) United States Patent
Luke et al.

(10) Patent No.: US 6,945,356 B2
(45) Date of Patent: Sep. 20, 2005

(54) TERMINATION ARRANGEMENT FOR A HORIZONTAL LIFELINE CABLE

(75) Inventors: Michael Luke, Blackwell (GB); Simon Luke, Solihull (GB)

(73) Assignee: Uniline Safety System Limited (GB)

( * ) Notice: Subject to any disclaimer, the term of this patent is extended or adjusted under 35 U.S.C. 154(b) by 0 days.

(21) Appl. No.: 10/433,598

(22) PCT Filed: Nov. 26, 2001

(86) PCT No.: PCT/GB01/05201

§ 371 (c)(1),
(2), (4) Date: Oct. 31, 2003

(87) PCT Pub. No.: WO02/43808

PCT Pub. Date: Jun. 6, 2002

(65) Prior Publication Data

US 2004/0069565 A1 Apr. 15, 2004

(30) Foreign Application Priority Data

Nov. 29, 2000 (GB) ..... 0029039

(51) Int. Cl.[7] ..... A47L 3/04

(52) U.S. Cl. ..... 182/3; 182/5; 182/7; 182/18; 188/65.1

(58) Field of Search ..... 182/3, 4, 5, 6, 182/7, 18, 48, 206, 230; 188/65.1; 244/137

(56) References Cited

U.S. PATENT DOCUMENTS

| | | | | | |
|---|---|---|---|---|---|
| 2,459,545 | A | | 1/1949 | Schultz | |
| 3,762,507 | A | | 10/1973 | Starr | |
| 4,095,415 | A | * | 6/1978 | Bower | 59/35.1 |
| 4,159,027 | A | * | 6/1979 | Caillet | 138/127 |
| 4,494,603 | A | * | 1/1985 | Harguindey | 166/231 |
| 5,136,755 | A | * | 8/1992 | Shaw | 24/122.6 |
| 5,458,214 | A | * | 10/1995 | Olson et al. | 182/18 |
| 5,988,101 | A | | 11/1999 | Jacobs et al. | |
| 6,005,191 | A | * | 12/1999 | Tzeng et al. | 174/102 R |
| 6,171,041 | B1 | * | 1/2001 | Bazinski et al. | 411/366.1 |
| 6,338,399 | B1 | * | 1/2002 | Choate | 188/374 |
| 6,533,066 | B1 | * | 3/2003 | O'Dell | 182/3 |
| 6,691,824 | B2 | * | 2/2004 | Sharp | 182/3 |
| 6,698,544 | B2 | * | 3/2004 | Kurtgis | 182/3 |

FOREIGN PATENT DOCUMENTS

| | | | | |
|---|---|---|---|---|
| CH | 271254 | | 1/1951 | |
| DE | 004012183 | A1 * | 10/1995 | 182/3 X |
| DE | 20209353 | * | 6/2002 | 182/3 X |
| JP | 408315645 | A * | 11/1996 | 182/3 X |
| JP | 02004049804 | A * | 2/2004 | 182/3 X |

OTHER PUBLICATIONS

International Search Reporst.

* cited by examiner

*Primary Examiner*—Bruce A. Lev
(74) *Attorney, Agent, or Firm*—Ira S. Dorman

(57) ABSTRACT

A termination arrangement for a horizontal lifeline cable (4) for use with a structure (6) includes an elongate stocking (14) of woven wire form surrounding an end section of the cable (4). The stocking (14) has a first end (22) adapted and arranged for secure connection to the structure (6), and a second end (28) secured to the cable (4). Tension applied to the cable results in elongation of the stocking (14) and contraction onto the cable so that the cable is securely gripped by the stocking.

22 Claims, 1 Drawing Sheet

TERMINATION ARRANGEMENT FOR A HORIZONTAL LIFELINE CABLE

Figure 1:
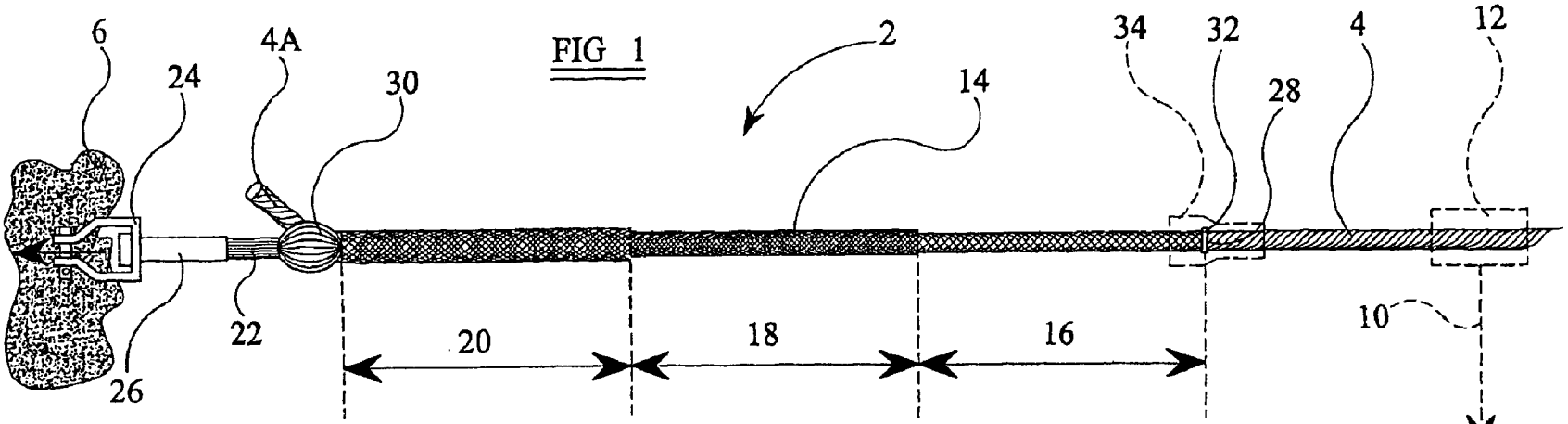

The present invention relates to horizontal lifeline cables for use with structures such as building structures and, more particularly, to a termination arrangement for such cables.

Horizontal lifeline cables are known to be installed at high levels on building structures and also on other high structures and arranged to provide protection against falling for people working on such structures. Such people wear a harness to which one end of a line is secured, the other end of the line being slidably secured, by means of an attachment device, to the horizontal lifeline cable.

Horizontal lifeline cables are generally wire-based and for securing them at their ends to structures, such as buildings, it is necessary to provide them with metal end terminations. These have hitherto required to be swaged onto the cables on site, once the cables have been cut to the required length. This is a complicated operation, leaving little room for error.

Wire-based horizontal lifeline cables have other disadvantages. They are required to be supported on a structure at relatively close distances of about 6 to 10 metres.

Wire-based cable systems are also highly elastic. As a result, a person falling and reaching maximum deflection on the cable tends to be thrown around as the system bounces up and down.

Wire-based cables are also abrasive, which is disadvantageous for line attachments sliding thereon.

Attention has been directed to replacing wire-based cables with cables comprising synthetic plastics fibres. Such cables are substantially non-abrasive, light in weight, and exhibit low stretch and low dynamic sag. They can span distances of up to 50 metres without intermediate support.

It is an object of the present invention to provide a termination arrangement for a horizontal lifeline cable which does not require on-site swaging of end terminations and which finds particular application to a cable comprising synthetic fibres.

According to the present invention there is provided a termination arrangement for a horizontal lifeline cable for use with a structure, the arrangement comprising an elongate stocking of woven wire form surrounding an end section of the cable, the stocking having a first end thereof adapted and arranged for secure connection to the structure, and a second end thereof secured to the cable, tension applied to the cable resulting in elongation of the stocking and contraction onto the cable whereby the cable is securely gripped by the stocking.

The structure may be a building.

The elongation of the stocking and contraction onto the cable, when tension is applied to the cable, may also serve to absorb dynamic loads applied to the cable, with consequential reduced application of dynamic loading to the structure.

The cable may comprise synthetic plastics fibres, such as polyester fibres. The fibres may be in the form of a bundle which may be enclosed in a jacket, such as of neoprene.

The stocking may comprise stainless steel.

The stocking may comprise plaited wires.

The stocking may comprise a section of single weave form adjacent the second end thereof and one or more sections of multiple weave form arranged consecutively therewith. Such sections of multiple weave form may comprise a section of double weave form followed by a section of triple weave form.

The second end of the stocking may be secured to the cable by means of a metal tie, such as of stainless steel.

A sleeve, such as of heat-shrinkable plastics material, may be provided surrounding and overlapping a junction between the second end of the stocking and the cable.

The second end of the stocking may be widenable to facilitate insertion thereinto of the end section of the cable.

The first end of the stocking may be provided with a region comprising a plurality of strands, adjacent strands being separable to allow a free end of the gripped end section of the cable to pass therebetween and out of the stocking for adjustment of length of the cable. One end of each of the strands may be encapsulated in a metal sheath, such as a swage termination.

The first end of the stocking may be secured, such as by swaging, to a termination means, the termination means being adapted for connection to a bracket means on the structure.

The termination means may include means to pre-tension the cable when assembled with the termination arrangement and installed on the structure. Such means to pretension the cable may comprise a turnbuckle arrangement.

The termination means may also include means to indicate correct pre-tension of the cable. This may comprise a disc which is rotatable on a component of the termination means when correct pre-tension of the cable is reached and whose ability to rotate is inhibited at less than correct pre-tension of the cable.

In summary, the termination arrangement of the invention is readily installed on a horizontal lifeline cable on site, without requiring any on-site swaging of the cable to a termination means, which has hitherto been necessary. The stocking, such as of plaited stainless steel wires, grips the cable when tension is applied and also serves to reduce structural loading when dynamic forces are experienced as a result of a person falling when secured by a line to the cable. The arrangement can be re-used after experiencing such dynamic forces.

The stocking is swaged onto the termination means in the factory, during manufacture.

The length of the cable can be readily adjusted simply by pulling the end thereof out between the separated strands provided at the first end of the stocking.

The grip of the stocking on the cable increases in tightness with increasing tension in the cable. A range of cable sizes from 12 to 19 mm in diameter can be accommodated and loads can be handled equivalent to at least a safety factor of two in accordance with current United Kingdom regulations for horizontal lifeline cable systems.

Figure 2:
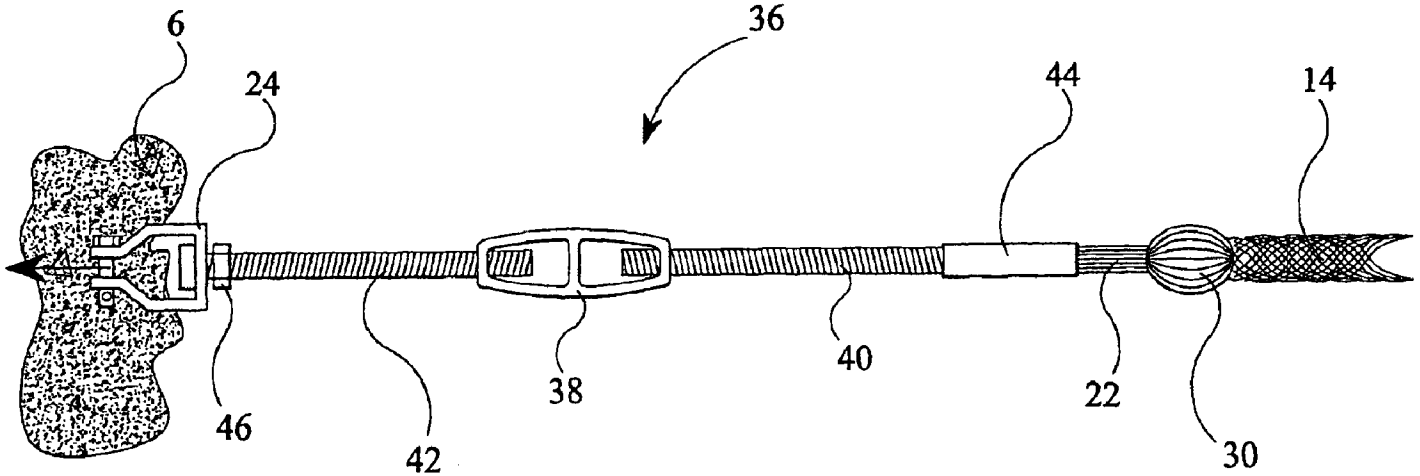

For a better understanding of the present invention and to show more clearly how it may be carried into effect, reference will now be made, by way of example, to the accompanying drawings in which:

FIG. 1 is a plan view of an embodiment of a termination arrangement according to the present invention for a horizontal lifeline cable for use with a structure, such as a building; and FIG. 2 is a plan view of a termination means with a pre-tensioning arrangement which is applicable as an alternative to the termination means in the termination arrangement of FIG. 1.

Referring to FIG. 1, a termination arrangement 2 is provided for a horizontal lifeline cable 4. The horizontal lifeline cable 4 is intended for securing in a substantially horizontal disposition to a structure 6, such as a building, at a high level thereon. The cable 4, when incorporated as part of a horizontal lifeline system, is designed to provide protection against falling for people working on the structure. A person 8 wears a harness to which one end of a safety line 10 is secured. The other end of the line 10 is provided with an attachment 12 which is arranged to slide along the cable 4 to accommodate movement of the person 8.

The ends of the cable 4 are required to be secured to the structure 6 such that the cable 4 is pre-tensioned in its securement.

The termination arrangement 2 comprises a stocking 14 of woven wire form and consisting of plaited stainless steel wires. The stocking 14 preferably comprises three adjoining sections 16, 18, 20 each having a different weave arrangement of stainless steel wire. A first section 16 is of single weave form, a second section 18 is of double weave form, and a third section 20 is of triple weave form.

A first end 22 of the stocking 14 is factory-fitted to a metal termination 24, using a swaged junction 26. The metal termination 24 is adapted to be secured to a suitable bracket (not shown) on the structure 6.

The cable 4 suitably comprises a bundle of synthetic plastics fibres, such as polyester fibres, and may be enclosed in a jacket, such as of neoprene.

An end section of the cable 4 is fed into the stocking 14 from a second end 28 of the stocking 14. The second end 28 of the stocking 14 is arranged to be widenable to facilitate insertion of the end of the cable 4.

The first end 22 of the stocking 14 is provided with a region 30 comprising a plurality of strands of the stocking material. Adjacent strands of region 30 are separable to enable end 4A of the cable 4 to pass therebetween and out of the stocking 14 after being pushed through the stocking 14 from the second end 28 thereof. This enables the length of the cable 4 to be adjusted as required. Additionally, a visible indication that the end 4A of the cable 4 is in the region 30 demonstrates the cable 4 has been inserted a minimum required distance into the stocking 14.

The second end 28 of the stocking 14 is secured to the cable 4 by means of a metal tie 32, such as of stainless steel.

A sleeve 34, such as of heat-shrinkable plastics material, is arranged to overlap the junction between the second end 28 of the stocking 14 and the cable 4.

The termination arrangement 2 is secured to the structure 6 such that a predetermined pre-tension is applied to the cable 4. When such pre-tension is applied, the stocking 14 elongates and contracts onto the cable 4 such that it securely grips the cable 4. The sections 16, 18 and 20 of progressively increasing weave of the stocking 14 provide progressively increasing strength of the stocking and securement thereof to the cable 4.

FIG. 2 shows a pre-tensioning arrangement 36 provided between the first end 22 of the stocking 14 and the metal termination 24. The pre-tensioning arrangement 36 comprises a turnbuckle device 38, of a form known per se, cooperating with associated rods 40, 42, at least one of which is threaded. The pre-tensioning arrangement 36 is factory-fitted to the first end 22 of the stocking 14 by means of a swaged junction 44 (or metal sheath).

A tension indicating disc 46 is provided at an interface between the rod 42 and the termination 24. When less than the correct amount of pre-tension exists in the cable 4, the disc 46 cannot be rotated on the rod 42. The cable is then pre-tensioned by rotating the turnbuckle 38. When the correct amount of pre-tension is reached, the disc 46 becomes free to rotate on the rod 42.

By way of example, a suitable overall length for the termination arrangement of FIG. 1 is about 1320 mm and a suitable overall length for the termination arrangement of FIG. 2 is about 1700 mm.

The termination arrangement 2 of the invention possesses a number of advantages. It is readily fitted to a cable on site without requiring any swaging operation on site.

It allows easy adjustment of cable length and cable pre-tensioning. It is readily adapted to a range of cable diameters from 12 to 19 mm.

When a tensile load is applied to the cable 4 the stocking 14 stretches and elongates and the more it elongates the tighter becomes its grip on the cable 4. Such stretching of the stocking 14 is advantageous in that it serves to absorb dynamic loads resulting from loads generated by a person falling on the cable 4. After the dynamic load is released, the stocking 14 returns to its original length and continues to fulfil its purpose.

If required, the stocking 14 can be removed from the end of the cable 4 and re-assembled, thus permitting replacement or maintenance to be carried out on any components of the horizontal lifeline cable system.

What is claimed is:

1. A horizontal lifeline system for use with a structure (6), the system incorporating a horizontal lifeline cable (4) and a termination arrangement, the termination arrangement comprising an elongate stocking (14) of woven wire form surrounding an end section of the cable (4), the stocking (14) having a first end (22) thereof adapted and arranged for secure connection to the structure (6), and a second end (28) thereof secured to the cable (4), tension 10 applied to the cable resulting in elongation of the stocking (14) and contraction onto the cable whereby the cable is securely gripped by the stocking.

2. A horizontal lifeline system as claimed in claim 1, wherein the cable (4) comprises synthetic plastics fibres.

3. A horizontal lifeline system as claimed in claim 2, wherein the fibres are in the form of a bundle which is enclosed in a jacket.

4. A horizontal lifeline system as claimed in claim 3, wherein the jacket comprises neoprene.

5. A horizontal lifeline system as claimed in claim 2, wherein the cable comprises polyester fibres.

6. A horizontal lifeline system as claimed in claim 1, wherein the stocking (14) comprises stainless steel.

7. A horizontal lifeline system as claimed in claim 1, wherein the stocking (14) comprises plaited wires.

8. A horizontal lifeline system as claimed in claim 1, wherein the stocking (14) comprises a section (16) of single weave form adjacent the second end thereof and one or more sections (18, 20) of multiple weave form arranged consecutively therewith.

9. A horizontal lifeline system as claimed in claim 8, wherein the sections of multiple weave form comprise a section (18) of double weave form followed by a section (20) of triple weave form.

10. A horizontal lifeline system as claimed in claim 1, and including a metal tie (32) securing the second end (28) of the stocking (14) to the cable (4).

11. A horizontal lifeline system as claimed in claim 10, wherein the metal tie comprises stainless steel.

12. A horizontal lifeline system as claimed in claim 1, wherein a sleeve (34) is provided surrounding and overlapping a junction between the second end (28) of the stocking (14) and the cable (4).

13. A horizontal lifeline system as claimed in claim 12, wherein the sleeve comprises heat-shrinkable plastics material.

14. A horizontal lifeline system as claimed in claim 1, wherein the second end (28) of the stocking (14) is widenable to facilitate insertion thereinto of the end section of the cable (4).

15. A horizontal lifeline system as claimed in claim 1, wherein the first end (22) of the stocking (14) is provided with a region (30) comprising a plurality of strands, adjacent strands being separable to allow a free end (4A) of the gripped end section of the cable (4) to pass therebetween and out of the stocking (14) for adjustment of length of the cable.

16. A horizontal lifeline system as claimed in claim 15, wherein one end of each of the strands is encapsulated in a metal sheath (26, 44).

17. A horizontal lifeline system as claimed in claim 16, wherein the metal sheath comprises a swage termination.

18. A horizontal lifeline system as claimed in claim 1, wherein the first end (22) of the stocking (14) is secured to a termination means (24), the termination means being adapted for connection to a bracket means on the structure (6).

19. A horizontal lifeline system as claimed in claim 18, wherein the termination means (24) includes pre-tensioning means (36) to pre-tension the cable (4) when assembled with the termination arrangement and installed on the structure (6).

20. A horizontal lifeline system as claimed in claim 19, wherein the pre-tensioning means (36) to pretension the cable (4) comprises a turnbuckle arrangement (38).

21. A horizontal lifeline system as claimed in claim 18, and including indicating means (46) to indicate correct pre-tension of the cable (4).

22. A horizontal lifeline system as claimed in claim 21, wherein the indicating means comprises a disc (46) which is rotatable on a component of the termination means when correct pre-tension of the cable (4) is reached and whose ability to rotate is inhibited at less than correct pre-tension of the cable.

* * * * *